United States Patent [19]

Chopp

[11] 4,058,719

[45] Nov. 15, 1977

[54] ADJUSTABLE FLASHLIGHT HOLDER

[76] Inventor: Peter G. Chopp, 9001 Golf Road, Des Plaines, Ill. 60016

[21] Appl. No.: 779,343

[22] Filed: Mar. 21, 1977

[51] Int. Cl.[2] ..... F21L 15/20

[52] U.S. Cl. ..... 362/190; 248/106; 248/139

[58] Field of Search ..... 240/52.5; 248/105, 106, 248/122, 126, 137, 139, 140, 141, 142

[56] References Cited

U.S. PATENT DOCUMENTS

| | | | |
|---|---|---|---|
| 1,527,479 | 2/1925 | Haunstein | 240/52.5 X |
| 1,771,754 | 7/1930 | Haunstein | 240/52.5 X |
| 2,084,162 | 6/1937 | Packard | 248/139 |
| 2,451,228 | 10/1948 | Lemerond | 240/52.5 X |
| 2,707,228 | 4/1955 | Philipson | 240/52.5 |
| 2,778,931 | 1/1957 | Creez | 240/52.5 |
| 3,144,232 | 8/1964 | Smootz | 248/126 UX |

*Primary Examiner*—Edna M. O'Connor
*Attorney, Agent, or Firm*—Bruce K. Thomas

[57] ABSTRACT

An adjustable flashlight holder is disclosed having a base member with a plurality of transverse spaced ridge elements or shaped depressions along its top surface and a bifurcated support hinged to one end to engage the flashlight at various angles. In one embodiment the arms of the support are biased toward each other sufficiently to engage the flashlight case diametrically and include an elastic member or spring upon which the case of the flashlight may rest at an angle. In another embodiment the hinge has one or more lock positions to hold the support at selected angles and folds down on top of or within the base member when not in use. The flashlight can be supported in a variety of convenient positions to facilitate use by a worker.

12 Claims, 13 Drawing Figures

ADJUSTABLE FLASHLIGHT HOLDER

BACKGROUND OF THE INVENTION

A flashlight normally must be held in the hand of the user or his helper in order to effectively direct the light to the work area. It is known in the art to provide flashlights with ring members at one end that they may be used to hang the light from a nail or suspended from one's belt. Flashlight cases also include clip members for this purpose. Some larger portable battery-operated lights have flat bases which facilitate placing the light in a stationary position on a flat surface. However, little attention has been paid in this art to the problem of effectively supporting a tubular flashlight in one or more positions so that the light therefrom can be directed to a work area at different angles.

SUMMARY OF THE INVENTION

In accordance with this invention the aforementioned problems are overcome by providing a support member for a flashlight that includes a base upon which the flashlight can be supported at a plurality of angles upwardly and a plurality of angles directing the light downwardly. The device includes a base member adapted to rest upon a flat surface and the base member includes a plurality of transverse ridges or notches against which the rear edge or the front edge of the flashlight may be engaged. A U-shaped or bifurcated support member is pivotally attached to or hingeably engaged by one end of the supporting base. Preferably this U-shaped member is made of wire rod and has two arms that extend in substantially parallel spaced relationship from the ends of a cross member that forms the hinge. An elastic member such as a spring, rubberband or ribbon of plastic is attached between the two arms of the support for the purpose of engaging the underside of the flashlight case. Not only can the angle of the light be changed by placing its base end or lens end against different notches or ridges on the base of the device but the attitude or height of the other end of the flashlight can be varied by moving the elastic member or spring upwardly or downwardly on the bifurcated arms of the hinged support. Thus, the flashlight can be supported with the light directed at a number of angles upwardly or a number of differnt angles downwardly.

The hinged U-shaped support member can have its cross member at the hinged end encompassed by a rolled end edge of the base when it is fabricated from sheet metal or the cross member can engage an end corner in the base defined by a bottom and an end wall. Also, the bottom of the base member may have a transverse slot which engages the cross member of the support to provide a hinged relationship. Means may also be included to hold the bifurcated support member at selected angles upwardly from one end of the base. The distance between the bifurcated arms of the supporting base may be substantially the same as or slightly less than the diameter of the flashlight case so as to engage the sides of the case and further grip the flashlight. This allows the flashlight to be set upon the base and held in a vertical position.

DESCRIPTION OF THE DRAWINGS

Illustrative embodiments of the invention are shown in the drawings wherein.

DESCRIPTION OF THE PREFERRED EMBODIMENTS

Figure 1:
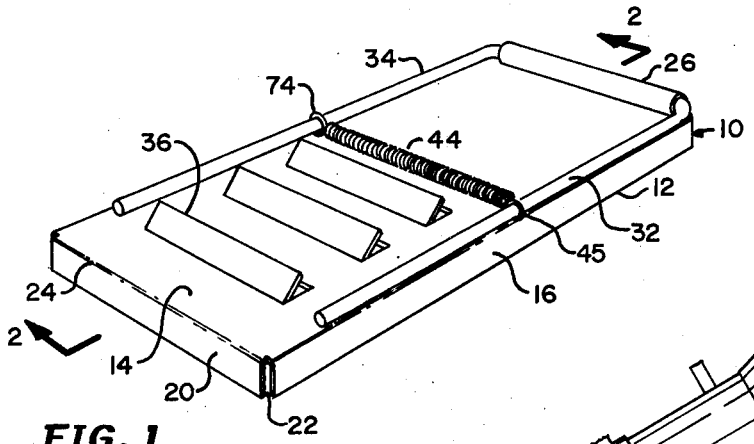
FIG. 1 is a perspective view of one form of the flashlight support of this invention, in this instance formed from sheet metal.
Figure 2:
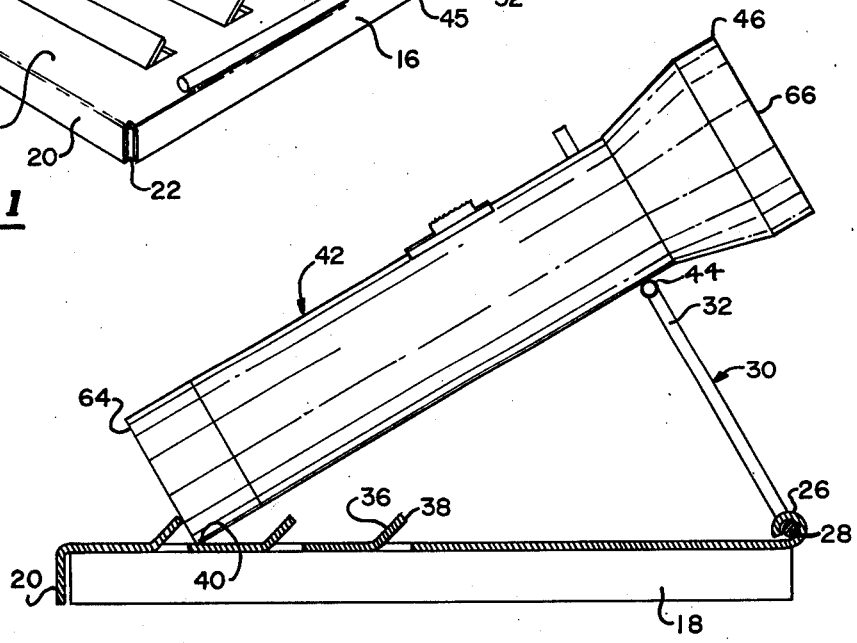
FIG. 2 is a cross-sectional view taken along lines 2—2 of FIG. 1 and showing a flashlight supported by the device.

Referring to FIGS. 1 and 2 the flashlight holder 10 is illustrated by a base member 12 defining a flat upper surface 14 and having downwardly directed side flanges 16 and 18 (FIG. 2) and a single end flange 20 all being of the same width so that the supporting base 12 can be placed on a planar surface to support a flashlight. The flanges 16, 18 and 20 are formed in the sheet metal base by cutting out the corners 22 and bending the flanges downwardly along the corner bends 24, for example.

The opposite end flange 26 has been formed into a tubular roll to engage over the transverse portion or cross member 28 of the bifurcated support 30. The support 30 has two parallel legs or arms 32 and 34 which are substantially the same length and slightly shorter than the length of the base 12. This arrangement provides a hinge at the rolled flange 26 which allows the bifurcated support 30 to lie flat on the base 12 as shown in FIG. 1 or assume various angular positions, one of which is illustrated in FIG. 2.

The base 12 includes a series of transverse spaced ridges 36 which have been formed or cut from the sheet metal so that they extend upwardly and provide a raised edge 38 against which the bottom corner 40 of the flashlight 42 can engage, as illustrated in FIG. 2. The ridges 36 need only be of a height and length sufficient to catch and hold the flashlight case corner 40 to keep it from sliding.

An elastic member illustrated by the coil spring 44 is tied across the legs 32 and 34 to engage under the case of the flashlight as shown in FIG. 2. In this instance the last coils 45 are bent out at each end to receive the rod members 32 and 34. Instead of a spring 44 an elastic band can be looped across the rod members 32 and 34 or a plastic ribbon can be used.

Figure 4:
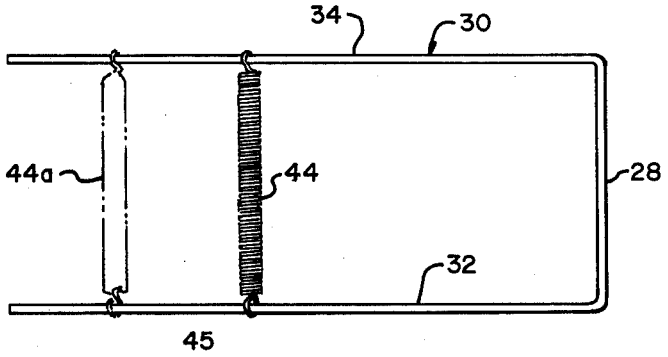
FIG. 4 is a plan view of the bifurcated hinged supporting member with the transverse elastic support shown in two positions along the bifurcated legs.

It is apparent from FIGS. 1 and 2 that the flashlight 42 can have its bottom corner 40 at the cap end engaging upon any one of the three ridges 36 shown or that the light can be reversed and the corner 46 can also engage these ridges, if one desires to reverse the position of the flashlight in the holder. Not only may the angle of the support 30 be changed but the longitudinal position of the elastic member 44 can be changed along the legs 32 and 34. This is shown in FIG. 4 wherein the spring 44 is shown in a full line position 44 and a broken line position at 44a.

Figure 3:
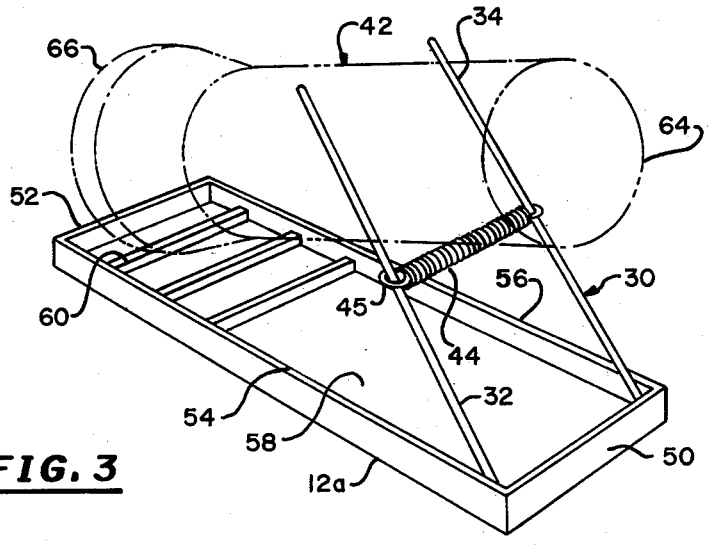
FIG. 3 is a perspective view of another form of the device, in this case fabricated from molded plastic with the flashlight supported thereby shown in broken lines.

In FIG. 3 another embodiment of the invention is shown employing a modified form of base 12a, in this case molded of plastic. The modified base 12a has the end sidewalls 50 and 52 and the longer sidewalls 54 and 56 which extend from and above the planar inner supporting surface 58. A series of three transverse and longitudinally spaced bar members 60 are attached to or formed as an integral part of the flat inner base 58.

Any length of spacing can be used for these bar members and any number of bar members may be employed. In this embodiment the hinged supporting member 30 used is the same as that shown in FIGS. 1 and 2. However, no special hinge means is employed in this embodiment and the transverse cross member 28, here hidden behind the end wall 50, merely engages in this corner defined by the inner surface of the upright wall 50 and the flat inner base portion 58.

The bifurcated support member 30 shown in FIG. 3 may hinge downwardly and be contained within the walls of the case when not in use. The flashlight 42 is shown in broken lines in FIG. 3 with its light or lens end 66 directed downwardly and the base end 64 in a raised position. The flashlight 42 can also engage the end wall 52 and still be supported by the member 30 and its transverse spring 44.

When the flashlight holder illustrated in FIGS. 1, 2 and 3 is used to support a flashlight in a vertical position the base end 64 would engage the flat surface 58 of the base 12 immediately between the rolled hinge end 26 or the end wall 50 and the innermost ridge 36 or bar 60 so that it would be upon a flat surface. The flashlight 42 can also be shifted from side to side between the walls 54 and 56 to further change the direction of lighting where the device is used in closed-in areas as may be found around machinery or furnaces and the like.

Figure 6:
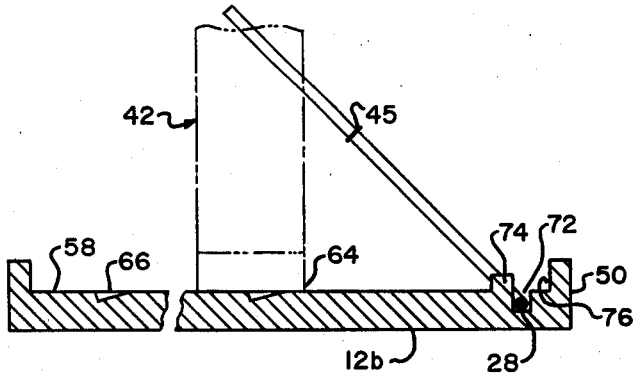
FIG. 6 is a fragmentary cross-sectional view of another form of the device shown supporting a flashlight in a vertical position.
Figure 8:
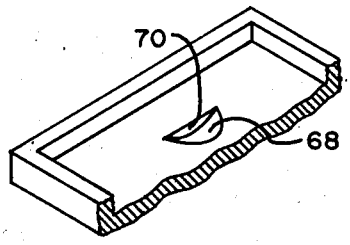
FIG. 8 is a fragmentary perspective view of one end of the device showing a modified form of detent to prevent the end of the flashlight from sliding on the base.
Figure 7:
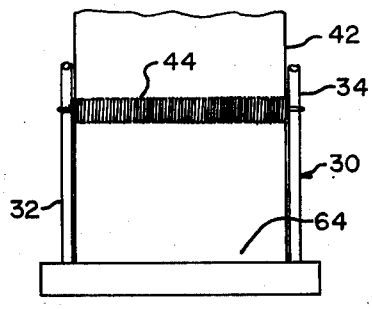
FIG. 7 is a fragmentary end view of the embodiment of FIG. 6.

In FIGS. 6 and 7 the vertical placement of a flashlight 42 at any position along the base is facilitated by providing a modified plastic base **12*b* wherein the top surface 58 is formed with a series of spaced or shaped notches 66, formed with an arcuate bottom 68 and a vertical end wall 70 as shown in FIG. 8. Such an indentation may be molded into the plastic body of the surface 58 so as to fit the corners 40 and 46** of the flashlight.

FIGS. 6 and 7 illustrate the manner in which a flashlight 42 can be supported in a vertical position wherein its base end 64 rests upon the flat surface 58 of the base 12b, the lens end projects vertically. The bifurcated support member 30 has its legs 32 and 34 on each side of the flashlight case and in a slight bearing relationship thereagainst. This can be accomplished by having the bifurcated legs 32 and 34 sprung or biased slightly inwardly and also by means of the spring 44 which can urge the bifurcated legs toward each other and against the flashlight case. In this position the spring 44 may or may not be slid to a position where it is in contact with the case. The spring 44 engages the legs 32 and 34 in a sliding relationship by means of the circular ends 45 which are bent around the legs 32 and 34.

The base 12b (FIG. 6) has the elongated transverse notch or groove 72 in the surface 58 between the end wall 50 and the second inner wall 74 which hingeably supports the bifurcated support 30 by receiving the cross member 28. Further adjustment is provided by the corner 76 wherein the cross member 28 can also fit.

Figure 5:
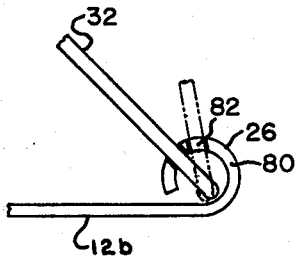
FIG. 5 is a fragmentary view of the hinge construction like that of FIG. 2 to show a modification wherein the end edge of the rolled edge of the sheet metal base bears one or more notches which hold the upright bifurcated supporting member in at least two angular positions.

In FIG. 5 it is shown that the edge 80 of the rolled hinge portion 26 can have one or more slots 82 which engage the leg 32 so that it will drop into the slots and assume different angular positions. The inwardly biased condition of the legs 32 and 34 facilitates this spring and detent action. One or both ends of the rolled hinge portion 26 can have such edge notches 82. The legs 32 and 34 may be sand blasted to increase their functional engagement with the spring edges 45 and the case of the flashlight 42.

The legs 32 and 34 can also be formed with outwardly curved off-sets that fit the contour of the sides of the case 42 with or without the biasing band 44. Alternately the legs 32 and 34 can converge toward each other at the cross-member 28, thus shortening the length of the cross-member. These embodiments could however limit the extent of vertical adjustments of the end of the flashlight supported thereby. However, this would allow the base member 12 to be fabricated in reduced widths. The length of the base member 12 is about that of a standard two-cell battery case or longer so as to accommodate three- and four-cell cases, if desired.

Figure 9:
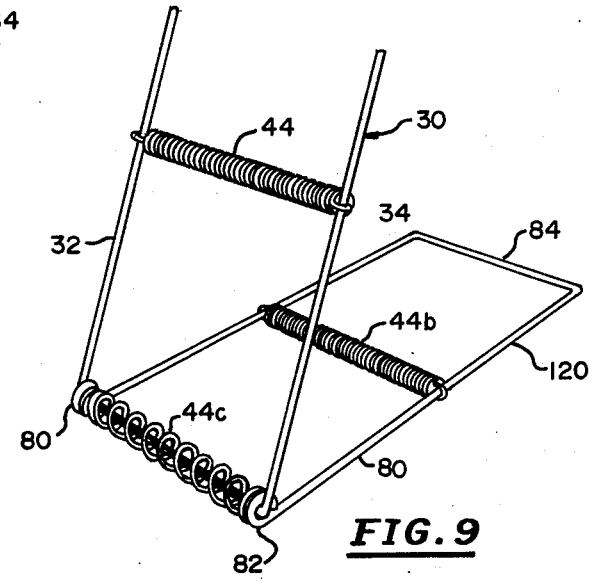
FIG. 9 is a perspective view of one modification of the invention.
Figure 10:
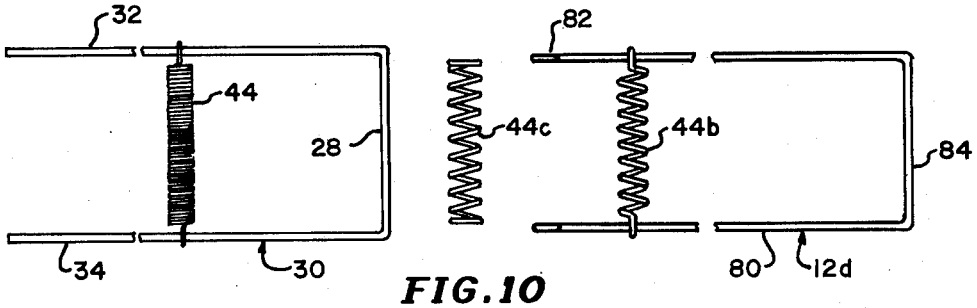
FIG. 10 is an exploded view of the hinge portion of the embodiment of FIG. 9.
Figure 11:
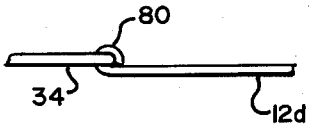
FIG. 11 is a fragmentary side view of the hinge portion of FIG. 9.

FIGS. 9, 10 and 11 illustrate a further embodiment wherein the modified base 12d is also formed of stiff wire and has the spaced legs 80 with the end eyelets 82 which encircle the cross member 28 at each end of the compression spring **44*c*. The spring 44*c* biases the legs outwardly so that the eyelets 82 engage the inside surfaces of the legs 32 and 34 of the bifurcated support member 30 in a sufficient frictional relationship so that this member can be placed at selected angles and support the flashlight 42 thereon. The cross bar 84 completes the structure of this base 12*d***.

The spring **44*b* replaces the notches 66 and bars 60 to perform their functions and also to be adapted to slide to selected positions along the legs 80. The springs 44 can be the same or different spiral configuration and the springs 44 and 44*b* can be rubber-coated. These parts are shown in disassembled relationship in FIG. 10**.

Figure 12:
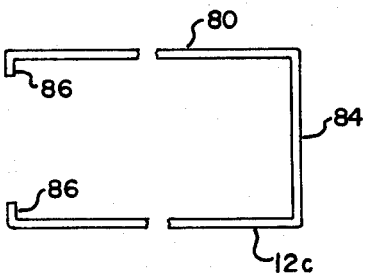
FIG. 12 is a fragmentary plan view of a modified base for use with the embodiment of FIGS. 9 and 10.

In FIG. 12 the further modified wire base **12*c* includes the inwardly bent tabs 86 which are adapted to engage within the open end loops of the spring 44*c* to form another combination of support, replacing the loops 82 shown in FIG. 9**.

The spring **44*b* has been omitted from the arms 80 of the base 12*c* for simplicity. The arms 80 would be spread to accomplish the engagement of the tabs 86** and facilitate assembly by hand.

Figure 13:
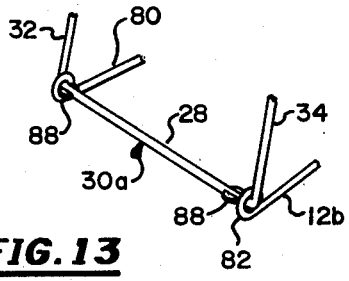
FIG. 13 is a fragmentary view of still another embodiment of the hinge that can be used with this invention.

In FIG. 13 the combination of the base **12*d* of FIG. 9 and a modified bifurcated support member 30*a* is shown wherein the cross-member 28 has been modified by peening at the points 88 just inside the eyelets 82 to form a hinge and keep the legs 80 in position. As shown in FIG. 11 both the spring 44c and the peened points 88 can be omitted if the eyelets are formed tighter about the cross-member 28. The cross-member 84 can be used as the only or additional support for the corners 40 and 46 of the flashlight 42**.

What is claimed is:

1. A holder for a flashlight and the like comprising:

a base member having a substantially flat upper surface;

said flat surface defining at least one transversely oriented upstanding edge between the ends of said base member;

hinge means at one end of said base member;

a bifurcated support member having extending spaced leg members and a cross member engageable with said hinge means and adapted to be moved to a plurality of angular positions about said hinge means and upwardly from the flat surface of said base member;

at least one elastic member suspended between the bifurcated legs of said support member whereby a flashlight may be placed with one end upon said base and engaging said upstanding edge, with the other end of the flashlight resting on said elastic member.

2. A holder in accordance with claim 1 in which:

said base member is formed of sheet metal;

said upstanding edge is formed in the flat surface thereof by striking the metal upwardlly into elongated raised portions; and said hinge means comprises a rolled flange engaging a transverse portion of said bifurcated support member.

3. A holder in accordance with claim 1 in which:

said legs of said bifurcated support member are biased toward each other to resiliently engage the case of said flashlight.

4. A holder in accordance with claim 1 in which:

a plurality of upstanding edges is provided in said flat surface and each is defined by a plurality of shaped indentations that conform substantially to the corner shape of the case of said flashlight.

5. A holder in accordance with claim 1 in which:

a plurality of said upstanding edges is provided and each is defined by said top surface in spaced relationship along the top surface of said base member.

6. A holder in accordance with claim 5 in which said hinge means comprises:

a rolled end wall of said base member that loosely encompasses said cross member.

7. A holder in accordance with claim 6 in which:

an end edge of said rolled end wall includes at least one detent groove which engages and holds said bifurcated support member in an angular position in relation to said base member.

8. A holder in accordance with claim 1 in which said hinge means comprises:

a groove in said top surface to rotatably receive the cross member of said bifurcated support member.

9. A holder for a flashlight and the like comprising:

a bifurcated base member having extended spaced co-planar leg members connected at one end to a cross-member;

a bifurcated support member having extended spaced co-planar leg members connected at one end by a cross-member;

means rotatably connecting the other ends of the leg members of said base member to the cross-member of said support member;

a second cross-member adjustably connecting across the span of the leg member of said base member; and a second cross-member adjustably connecting across the span of the leg members of said support member;

whereby the angular placement of said support member in relation to said base member provides angularly spaced support for the end edges of said flashlight in a plurality of orientations.

10. A holder in accordance with claim 9 in which:

said second cross-members are resilient coil springs the end loops of which engage said respective leg members in sliding tensioned relationship.

11. A holder in accordance with claim 9 in which:

means are included to frictionally engage said rotatable connecting means and thereby affix said support member in a plurality of angular positions.

12. A holder in accordance with claim 9 wherein:

said rotatable connecting means is defined by end eyelets in said leg members of said base member encompassing the cross-member of said support member;

at least one of said eyelets having detent means against which a leg member of said bifurcated support is retained at a selected angular displacement.

* * * * *